US006575333B1

(12) United States Patent
Raboin

(10) Patent No.: US 6,575,333 B1
(45) Date of Patent: Jun. 10, 2003

(54) CHILD RESISTANT SPOUT CLOSURE

(75) Inventor: Ronald K. Raboin, DePere, WI (US)

(73) Assignee: Western Industries, Inc., Chilton, WI (US)

( * ) Notice: Subject to any disclaimer, the term of this patent is extended or adjusted under 35 U.S.C. 154(b) by 0 days.

(21) Appl. No.: 09/718,776

(22) Filed: Nov. 22, 2000

(51) Int. Cl.[7] ..... B65D 55/16

(52) U.S. Cl. ..... 222/153.14; 222/546; 222/550; 215/206; 215/306; 220/375

(58) Field of Search ..... 222/153.14, 546, 222/549, 550, 556, 568, 569; 215/206, 224, 225, 306; 220/375

(56) References Cited

U.S. PATENT DOCUMENTS

| | | | | | |
|---|---|---|---|---|---|
| 3,584,760 A | | 6/1971 | Grinker | 220/60 |
| 3,765,578 A | | 10/1973 | Stull | 222/546 |
| 3,865,267 A | * | 2/1975 | Morris | 215/206 |
| 3,877,598 A | * | 4/1975 | Hazard | 222/546 |
| 4,281,778 A | * | 8/1981 | Stull | 222/153.14 |
| 4,334,639 A | * | 6/1982 | Gach | 222/153.14 |
| 5,292,017 A | | 3/1994 | Reifers | 215/206 |
| 5,593,054 A | | 1/1997 | Glynn | 215/225 |

* cited by examiner

*Primary Examiner*—Joseph A. Kaufman
(74) *Attorney, Agent, or Firm*—Foley & Lardner

(57) ABSTRACT

A method for removing a child-resistant spout closure cap from a spout on a container and a child-resistant spout closure for a container configured to hold either a liquid or a solid material, with the container including a fill opening to the interior of the container and an elongated hollow spout having a distal end and a proximate end, with the proximate end configured to align with the fill opening of the container. The child-resistant spout closure comprises a lip formed on the distal end of the spout defining a spout opening in fluid communication with the interior of the spout, with the lip having a closure recess extending through the lip to a spout wall; and, a cap configured to fill the spout opening. The cap has a lock nub configured to engage the lip and seal the spout opening and selectively pass through the closure recess when the lock nub and the closure recess are aligned. When the lock nub and the closure recess are aligned, the cap is removable from the spout.

18 Claims, 4 Drawing Sheets

CHILD RESISTANT SPOUT CLOSURE

FIELD OF THE INVENTION

The present application relates generally to the field of closure caps for containers and in particular to a child-resistant spout closure for a container with a "fluid tight" seal.

BACKGROUND OF THE INVENTION

Child-resistant caps have been in existence for some time and are applied typically to medicine containers such as pill bottles. Prior closure concepts dealing with child-resistant closures include closures that require specific alignment with designated locations on the container or will require the cap to be deformed, typically in an elliptical shape, to disengage a detent molded inside the cap. Additional configurations require locking or latching devices coupled to the cap and container to prevent unauthorized access to the material contained in the container.

Although prior child-resistant closures may prevent children from accessing the material in the container, such devices also inhibit the use of the material in the container by adults, particularly senior citizens. Recent legislation concerning limiting access of children to hazardous materials has been adopted at both the Federal and State levels. Such legislation typically requires that the closures prevent or significantly inhibit a child, up to 51 months, from accessing the material contained in the container but yet must allow senior adults and younger adults to readily use the material in the container.

There are also requirements that if flammable material such as gasoline or other petroleum products are carried in a container, not only does the cap have to be child-resistant but there are certain pressure requirements must be met in order to have such containers utilized in the marketplace. For instance, the closures used on containers for flammable materials such as gasoline or other petroleum products must be capable of sealing the contents in the container to an internal pressure of 20 pounds per square inch in order for such containers to be sold in the marketplace. In addition, in the case of a hazardous material carrier that utilizes a spout, the end of the spout must also have a child-resistant cap. The spout that is used to decant the material from the container and the spout that is used to allow air into the container during the decanting procedure should each have a child-resistant closure.

Thus, there is a need for a child-resistant container spout closure that will inhibit children from accessing the materials inside of a container. There is a further need for a child-resistant container closure that will allow adults, including senior citizens to readily access the interior of a container having such child-resistant container spout closure. Further, there is a need for a child-resistant container spout closure that will seal a liquid, such as a hazardous material, i.e., gasoline, to inhibit a child from opening such container but yet allowing an adult to readily utilize such container and remove the child-resistant container spout closure. And, there is a need for a container spout and vent closures that seal the contents within the container to prescribed pressure conditions while providing a means to inhibit access to the contents by children.

SUMMARY OF THE INVENTION

The present invention provides a child-resistant spout closure for a container configured to hold either a liquid or a solid material, with the container including a fill opening to the interior of the container and an elongated hollow spout having a distal end and a proximate end, with the proximate end configured to align with the fill opening of the container. The child-resistant spout closure comprises a lip formed on the distal end of the spout defining a spout opening in fluid communication with the interior of the spout, with the lip having a closure recess extending through the lip to a spout wall; and, a cap configured to fill the spout opening. The cap has a lock nub configured to engage the lip and seal the spout opening and selectively pass through the closure recess when the lock nub and the closure recess are aligned. When the lock nub and the closure recess are aligned, the cap is removable from the spout. Another embodiment of the present child-resistant spout closure includes a ring formed on the spout wall a spaced apart distance from the lip, wherein the ring inhibits removal of the cap when the cap is engaged with the lip and the lock nub is not aligned with the closure recess. A shelf on the exterior surface of the cap and aligned with the lock nub facilitates alignment of the lock nub with the closure recess and the lifting of the cap from the spout. A tether can couple the cap to the spout.

The present invention also provides a liquid holding container comprising a vessel having a tubular neck defining a fill opening in communication with the interior of the container. An elongated hollow spout, having a distal end and a proximate end, with the proximate end configured to align with the fill opening of the container can be coupled to the container with a closure member having an orifice sized to receive the spout and configured to threadingly engage the container and seal the fill opening of the container. A child-resistant spout closure configured to engage the distal end of the spout is also provided. The child-resistant spout closure comprises a lip formed on the distal end of the spout defining a spout opening. The spout opening is in fluid communication with the interior of the spout with the lip having a closure recess extending through the lip to a spout wall. A cap configured to fill the spout opening, with the cap having a lock nub configured to engage the lip and seal the spout opening and selectively pass through the closure recess when the lock nub and the closure recess are aligned. When the lock nub and the closure recess are so aligned, the cap is removable from the spout.

The present invention also provides a method for removing a child resistant spout closure cap from an elongated hollow spout on a container. The container is configured to hold either a liquid or a solid material and has a fill opening to the interior of the container. The spout having a distal end and a proximate end, with the proximate end configured to align with the fill opening of the container and with the distal end configured with a lip having a closure recess extending through the lip to a spout wall. The cap has a lock nub configured to engage the lip and seal the spout and selectively pass through the closure recess when the lock nub and the closure recess are aligned. The cap has a shelf on the exterior surface of the cap aligned with the lock nub. The method for removing the child-resistant spout closure cap comprises the steps of applying a rotational force to the shelf on the cap until the lock nub aligns with the closure recess. Then applying a lifting force to the shelf while maintaining the rotational force and removing the cap from the spout. With the child-resistant spout closure cap removed from the spout, the container can be filled or decanted with a material such as a liquid. After either filling or decanting a material from the container, the additional steps of replacing the cap on the spout and applying a force to the cap until a lock nub engages the lip and seals the spout can be performed.

DETAILED DESCRIPTION OF THE EXEMPLARY EMBODIMENTS

Figure 1:
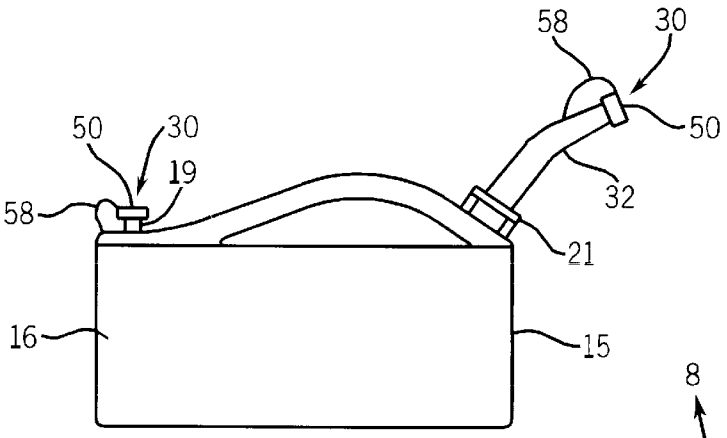
FIG. 1 is a plan side view of a container with an examplary embodiment of a child-resistant spout closure on a vent spout and on a fill spout.
Figure 12:
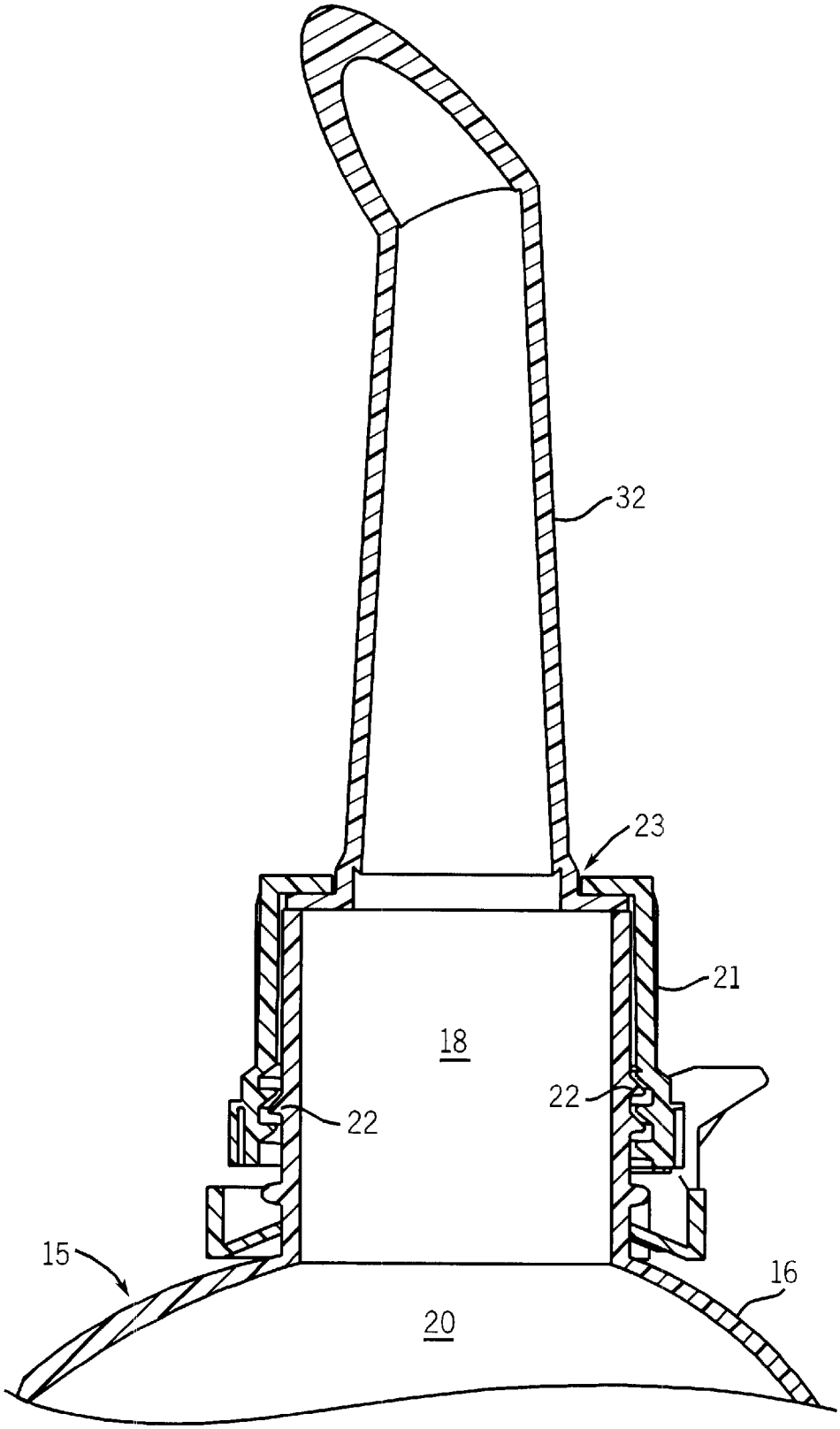
FIG. 12 is a partial cut-away side view of a spout configured to engage a closure member, with the closure member having an orifice sized to receive the spout and configured to threadingly engage the container and sealing the fill opening of the container.

Referring to FIG. 1, there is illustrated a side-plan view of a container 15, also referred to as a vessel, having a spout 32 mounted on he container 15 and a vent 19 also mounted on the container 15. The spout and vent are each in fluid communication with the interior 20 of the container 15 through a fill opening 18 (See FIG. 12). Each of the fill spout 32 and the vent 19 have a child-resistant spout closure 30 sealing a distal end 34 of the child-resistant spout closure 30. The container 15 is configured to hold either a liquid or a solid material. The container 15 is composed of material that is compatible as to structural and chemical characteristics, of the material it will contain. The container can be manufactured by any suitable and convenient method such as blow molding. The container can be made from any suitable material such as, for example, polyester, polyamide (example—nylon), polystyrene, acetyl, or polyoefinic materials, e.g., various grades of polyethylene or polypropylene or such other suitable material that is appropriate for the type of material, liquid or solid that will be contained in the container 15. Where the container is designed to hold a flammable liquid, such as gasoline, examples of suitable materials for forming the container include medium and high density grades of polyethylene. The spout 32 and the container 15 can be integrally formed as a single unit during the manufacturing process.

Figure 2:
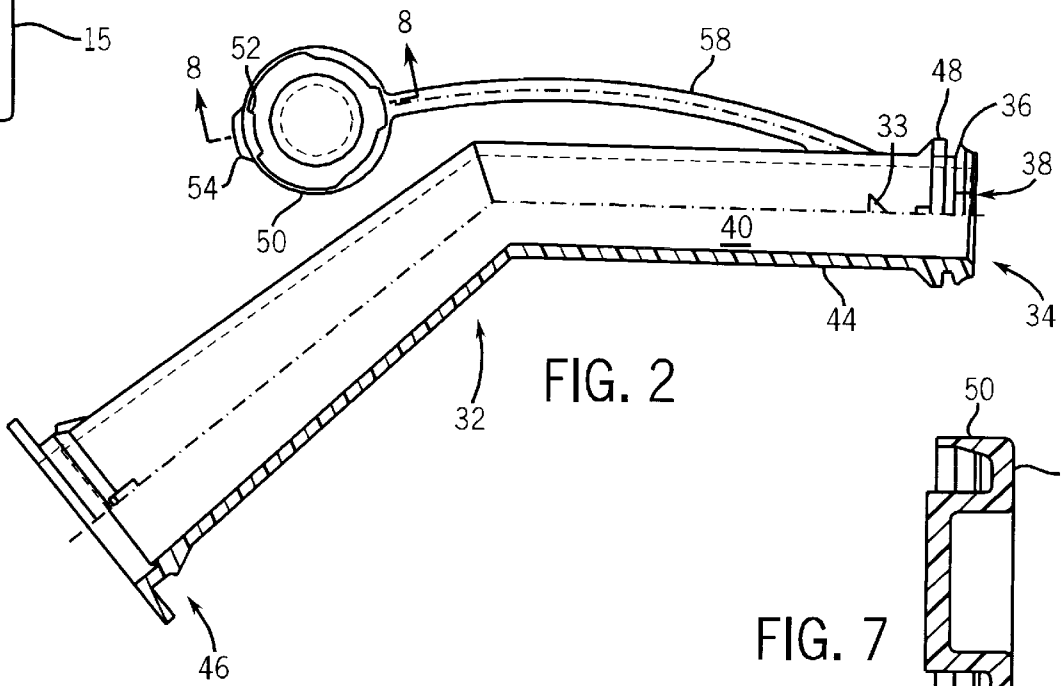
FIG. 2 is a partial cut-away, side view of a spout with an examplary embodiment of a child-resistant spout closure illustrating a cap coupled to the spout with a tether.
Figure 8:
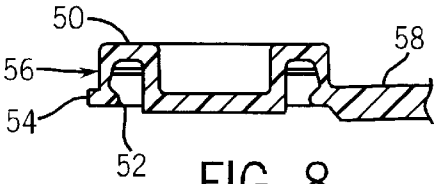
FIG. 8 is a sectional view of the cap illustrated in FIG. 2 along the line 8—8.
Figure 7:
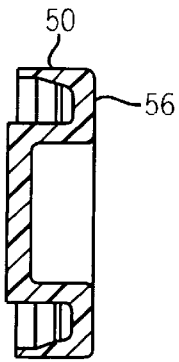
FIG. 7 is a sectional view of the cap illustrated in FIG. 6 along the line 7—7.
Figure 5:
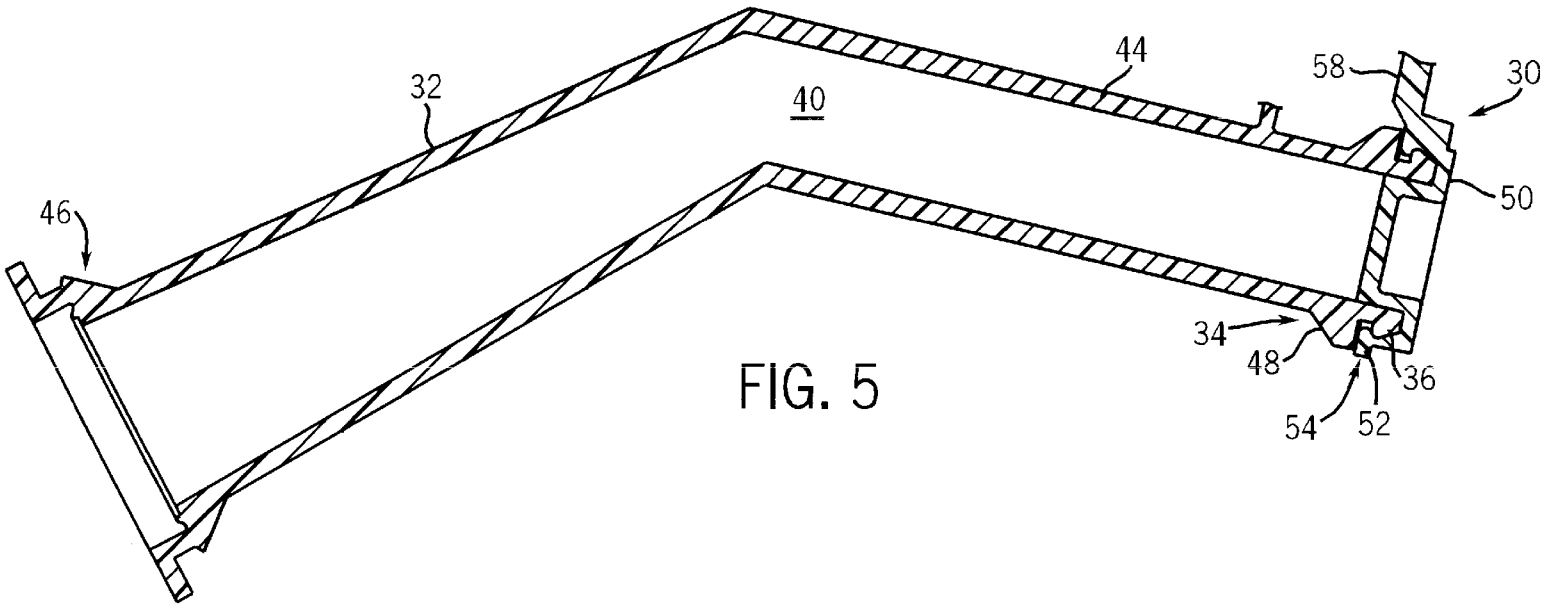
FIG. 5 is a sectional side view of a fill spout with an examplary child-resistant spout closure closing the opening of the spout.
Figure 10:
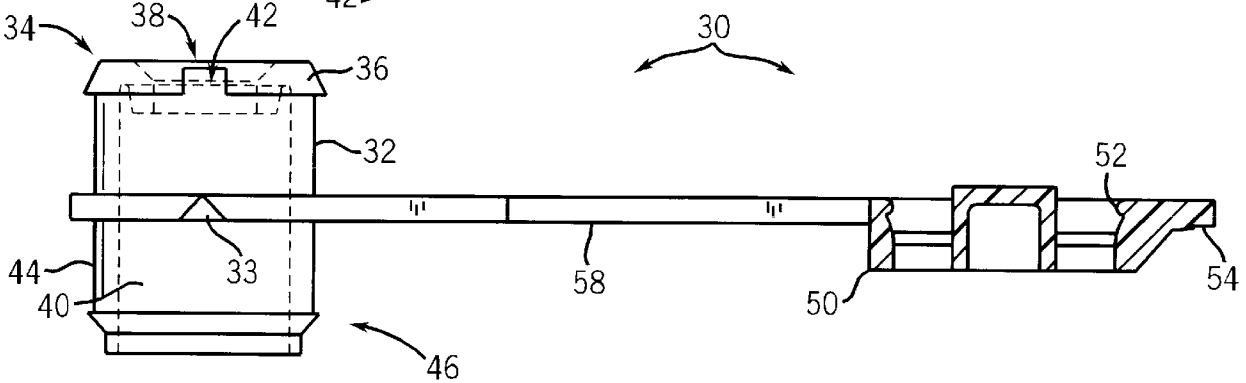
FIG. 10 is a side plan view of the child-resistant spout closure illustrated in FIG. 9 and further illustrating a sectional view of the cap shown in FIG. 9 along the line 10—10.

Referring now to FIGS. 2–8, there is shown a spout 32 having a distal end 34 and a proximate end 46 with the spout configured as an elongated hollow tube. The spout wall 44 can be any suitable thickness with the spout 32 formed to provide an interior 40 which is in fluid communication with the interior 20 of the container 15 through a fill opening 18 in the container. The spout 32 can be configured to be substantially straight along its full longitudinal length as shown in FIG. 10, or it can be substantially straight along its longitudinal length but taper to a smaller diameter at the distal end as compared to the diameter at its proximate end. It can also have a curve or bend midway between the proximal end and the distal end as shown in FIGS. 2 and 5.

The child-resistant spout closure 30 comprises a lip 36 defining a spout opening 38. The spout opening 38 is in fluid communication with the interior 40 of the spout. The lip 36 defines a closure recess 42 extending through the lip 36 to the spout wall 44. See FIGS. 4, 9 and 10. The child-resistant spout closure 30 also includes a cap 50 configured to fill the spout opening 38, with the cap 50 having a lock nub 52 configured to engage the lip 36 and seal the spout opening 38. The seal formed by the interface of the cap 50 within the spout opening 38 is configured to withstand a minimum internal pressure of 20 pounds per square inch—gauge (psi-g). The seal may also be formed by a gasket or o-ring, however, such seal must withstand a minimum internal pressure of 20 psi-g. The lock nub 52 is also configured to selectively pass through the closure recess 42 when the lock nub 52 and the closure recess 42 are aligned. When the lock nub 52 and the closure recess 42 are so aligned, the cap 50 is removable from the spout 32 thereby allowing the material in the container 15 to be decanted or filled through the spout 32. The container 15 may also be provided with an additional opening for filling the container. Such additional opening will have its own closure. In one embodiment of the child-resistant spout closure 30, the lock nub 52 is a protrusion formed on an interior wall of the cap (See FIGS. 8 and 2) with the lock nub 52 engaging the underside of the lip 36 which lip 36 has a truncated cone geometry and completely around the spout opening 38 on the distal end 34 of the spout 32. The recess opening 42 and the lip 36 are configured to correspond to the size of the lock nub 52 so that the lock nub 52 can pass through the closure recess 42 during the removal process described below. The cap 50 forms a liquid tight seal with the spout opening 38 when the cap is engaged with the lip 36 of the spout 32. (See FIG. 5)

Another embodiment of the child-resistant spout closure includes a ring 48 formed on the spout wall 44 a spaced apart distance from the lip 36. The ring 48 inhibits removal of the cap 50 when the cap 50 is engaged with the lip 36 and the lock nub 52 is not aligned with the closure recess 42. (See FIGS. 2, 3 and 5) With the cap in place on the distal end 34 of the spout 32 as shown in FIG. 5, and with the cap rotated to either side of the closure recess 42 so that the lock nub 52 is not aligned with the closure recess 42 it is not possible to lift the underside of the cap 50 because of the ring 48. It is this feature that inhibits a child from removing the cap 50 from the spout 32 and accessing the material, hazardous or otherwise, from the interior of the container 15.

Figure 6:
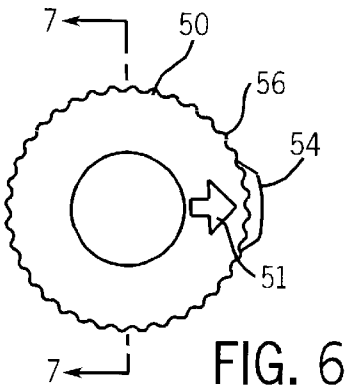
FIG. 6 is a top view of an examplary embodiment of a cap of a child-resistant spout closure.
Figure 4:
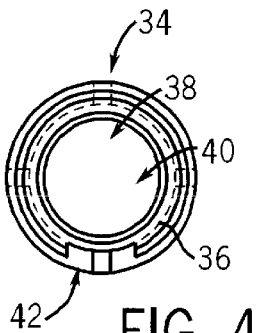
FIG. 4 is an end perspective view of the distal end of the spout illustrated in FIG. 3.
Figure 3:
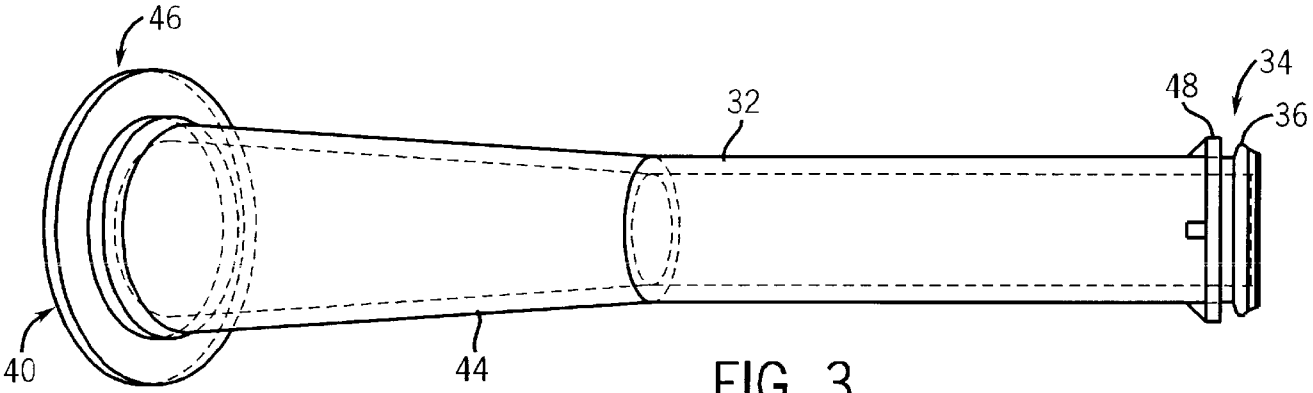
FIG. 3 is a top perspective view of a spout.

One embodiment of the child-resistant spout closure includes a shelf 54 mounted on an exterior surface 56 of the cap 50 with the shelf 54 aligned with the lock nub 52. In an examplary embodiment, the shelf 54 is on an exterior sidewall of the cap 50 (See FIGS. 6 and 8). The shelf 54 is aligned on the outside of the cap 50 with the lock nub 52 formed on the inside wall of the cap 50 as described above. Indicia 51 of the location of the lock nub 52 can also be provided on the top surface of the cap 50 as shown in FIG. 6 which provides an indication as to where the cap 50 should be rotated to align with the closure recess 42 defined in the lip 36. Spout indicia 33 can be provided to indicate the location of the closure recess 42 (See FIG. 2).

A tether 58 couples the cap 50 to the spout 32. The tether 58 functions not only to couple the cap 50 with the spout 32 but also provides a biasing force which tends to rotate the cap 50 away from the closure recess 42. To open the cap 50, an operator must rotate the cap 50 to align the lock nub 52 with the closure recess 42, as facilitated by the cap indicia 51 and the spout indicia 33. The rotation of the cap 50 increases the bias force exerted by the tether 58 which inhibits the action of a child but not to the extent that an adult or an elderly person cannot overcome such bias force. With the lock nub 52 aligned with the closure recess 42, an operator can apply a lifting force to the shelf 54 while maintaining the rotational force on the cap 50 and remove the cap 50 from the spout 32. At that time the tether 58 retains the cap 50. At this point in time, the operator can either fill or decant material to or from the container. When the filling or decanting steps are completed, the cap can be replaced on the distal end 34 of the spout 32 with the operator applying a force to the cap 50 until the lock nub 52 engages the lip 36 and seals the spout 32. During the closure procedure, it is not necessary for the lock nub 52 to be aligned with the closure recess 42. The lock nub 52 will snap over the lip 36 and engage the underside of the lip to effect the fluid seal of the spout 32. At that time, the tether 58 again asserts a biasing force to rotate the cap so the lock nub 52 and the closure recess 42 are misaligned and the cap 50 cannot be removed.

Figure 9:
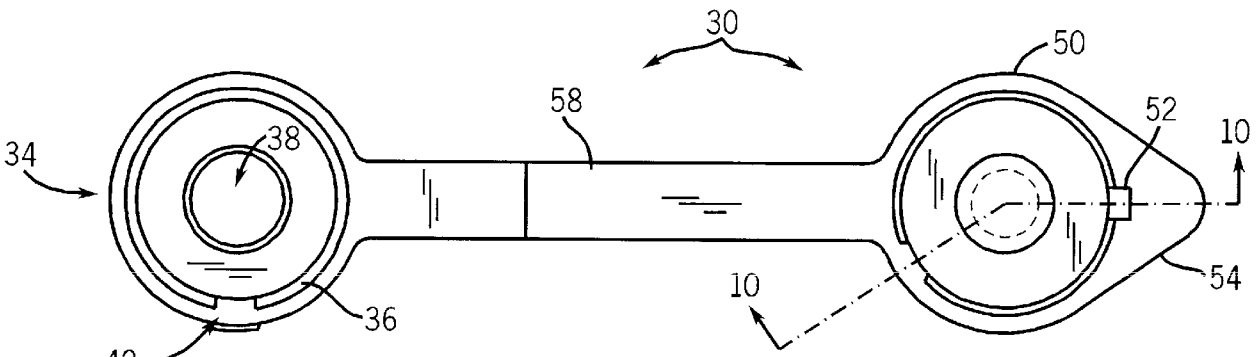
FIG. 9 is a bottom-plan view of an examplary embodiment of a child-resistant spout closure for a vent in a container.
Figure 11:
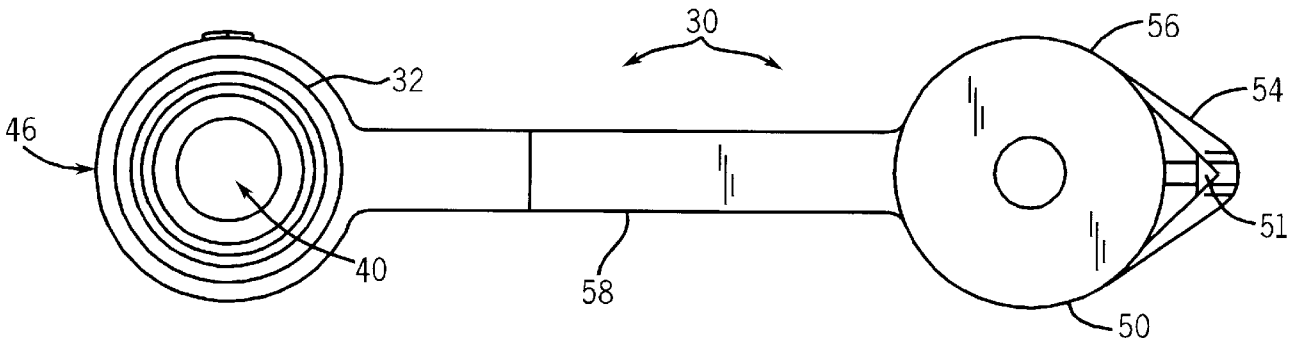
FIG. 11 is a top plan view of a child-resistant spout closure illustrated in FIG. 9.

Another embodiment of the child-resistant spout closure is illustrated in FIGS. 9–11. In this embodiment, the spout 32 is placed in an opening of the container wall 16 of the container 15 to provide a vent into the interior 20 of the container 15. For a typical installation, the proximate end 46 of the spout 32 is placed in the opening 18 in the container wall 16 and is secured in place in any convenient fashion such as with a detent or an adhesive or a sonic weld or the like. The child-resistant spout closure 30 functions as described above for a fill spout as to the opening and closing of the cap on the distal end 34 of the spout 32. However, because of the relative size of the spout opening 38, the vent 19 functions to allow the ingress of air into the interior 20 of the container 15 to equalize pressure and allow the smooth flow of material through the fill spout. Since a child can access the interior 20 of the container 15 through the venting and thereby access the material contained in the container, an apparatus and method that will inhibit a child from opening the cap 50 is required. The present child-resistant spout closure 30 provides such apparatus and method.

In the embodiments described above, the spout 32, the cap 50 and the tether 58 may be manufactured, such as by extrusion, with a somewhat stiff material such as acetal. It is also contemplated that such elements can be manufactured from the same type of material that the container 15 is made from. It is further contemplated that the spout 32 and the container 15 can be integrally formed as a single unit during the manufacturing process.

While the embodiments illustrated in the figures and described above are presented to illustrate the present invention, it should be understood that these embodiments are offered by way of example only. The invention is not intended to be limited to any particular embodiment, but is intended to extend to various modifications that nevertheless fall within the scope of the appended claims. For example, the container can be provided with a neck supporting a clutch ring having a clutch tab which includes a plurality of clutch teeth that engage a plurality of teeth on the closure member wherein the teeth of the closure member remain engaged with the clutch teeth until at least one clutch tab is moved away from the teeth of the closure member to further inhibit child access to the interior of the container. The container can also be configured to provide for the spout to be threaded into the interior portion of the container. The fill spout can also be configured to be stored in the interior of the container with an appropriate closure member being provided with a plug to close the orifice in the closure member which was sized to engage the fill spout. Other modifications will be evident to those of ordinary skill in the art.

What is claimed is:

1. A child-resistant spout closure for a container configured to hold either a liquid or a solid material, with the container including a fill opening to the interior of the container and an elongated hollow spout having a distal end and a proximate end, with the proximate end configured to align with the fill opening of the container, the child-resistant spout closure comprising:

a non-rotating lip formed on the distal end of the spout defining a spout opening in fluid communication with the interior of the spout, with the non-rotating lip having a closure recess extending through the lip to a spout wall; and, a cap configured to fill the spout opening, with the cap having a lock nub configured to engage the non-rotating lip and seal the spout opening and selectively pass through the closure recess when the lock nub and the closure recess are aligned, wherein the cap is removable from the spout.

2. The child-resistant spout closure of claim 1, including a tether coupled to the cap and the spout.

3. The child-resistant spout closure of claim 1, wherein the cap in the spout opening seals the spout opening against an internal pressure of at least 20 psi-g.

4. The child-resistant spout closure of claim 3, including a ring formed on the spout wall a space apart distance from the lip, wherein the ring inhibits removal of the cap when the cap is engaged with the lip and the lock nub is not aligned with the closure recess.

5. The child-resistant spout closure of claim 4, wherein the cap includes a shelf on the exterior surface of the cap, with the shelf aligned with the lock nub.

6. The child-resistant spout closure of claim 1, wherein the spout is configured to engage a closure member having an orifice sized to receive the spout and configured to threadingly engage the container and seal the fill opening of the container.

7. The child-resistant spout closure of claim 1, wherein the container is configured to hold flammable liquid.

8. A liquid holding container comprising:

a vessel having a tubular neck defining a fill opening in communication with the interior of the container;

an elongated hollow spout having a distal end and a proximate end, with the proximate end configured to align with the fill opening of the container; and, a child-resistant spout closure configured to engage the distal end of the spout, the child-resistant spout closure comprising:

a non-rotating lip formed on the distal end of the spout defining a spout opening in fluid communication with the interior of the spout, with the non-rotating lip having a closure recess extending through the lip to a spout wall; and, a cap configured to fill the spout opening, with the cap having a lock nub configured to engage the non-rotating lip and seal the spout opening and selectively pass through the closure recess when the lock nub and the closure recess are aligned, wherein the cap is removable from the spout.

9. The container of claim 8, including a tether coupled to the cap and the spout.

10. The container of claim 8, wherein the cap in the spout opening seals the spout opening against an internal pressure of at least 20 psi-g.

11. The container of claim 10, including a ring formed on the spout wall a space apart distance from the lip, wherein the ring inhibits removal of the cap when the cap is engaged with the lip and the lock nub is not aligned with the closure recess.

12. The container of claim 11, wherein the cap includes a shelf on the exterior surface of the cap, with the shelf aligned with the lock nub.

13. The container of claim 8, wherein the spout is configured to engage a closure member having an orifice sized to receive the spout and configured to threadingly engage the container and seal the fill opening of the container.

14. The container of claim 8, wherein the container is configured to hold flammable liquid.

15. A method for removing a child-resistant spout closure cap from an elongated, hollow spout on a container, the container configured to hold either a liquid or a solid material and having a fill opening to the interior of the container, the spout having a distal end and a proximate end, with the proximate end configured to align with the fill opening of the container and with the distal end configured with a non-rotating lip having a closure recess extending through the non-rotating lip to a spout wall, the cap having a lock nub configured to engage the lip and seal the spout and selectively pass through the closure recess when the lock nub and the closure recess are aligned, with the cap having a shelf on the exterior surface of the cap aligned with the lock nub, the method comprising the steps of:

applying a rotational force to the shelf on the cap until the lock nub aligns with the closure recess;

applying a lifting force to the shelf while maintaining the rotational force; and, removing the cap from the spout.

16. The method for removing a child-resistant spout closure cap of claim 15, including one of the steps of filling and decanting the container with a liquid.

17. The method for removing a child-resistant spout closure cap of claim 15, wherein the liquid is a flammable liquid.

18. The method for removing a child-resistant spout closure cap of claim 15, including, after either step of filling or decanting, the steps of replacing the cap on the spout and applying a force to the cap until the lock nub engages the lip and seals the spout.

* * * * *